US008624472B2

(12) United States Patent
Yoshimoto

(10) Patent No.: US 8,624,472 B2
(45) Date of Patent: Jan. 7, 2014

(54) SPARK PLUG FOR INTERNAL COMBUSTION ENGINE

(75) Inventor: Osamu Yoshimoto, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 278 days.

(21) Appl. No.: 12/195,614

(22) Filed: Aug. 21, 2008

(65) Prior Publication Data

US 2009/0051259 A1 Feb. 26, 2009

(30) Foreign Application Priority Data

Aug. 23, 2007 (JP) ..... 2007-217472

(51) Int. Cl.
*H01T 13/39* (2006.01)
*H01T 13/20* (2006.01)

(52) U.S. Cl.
USPC ..... 313/141; 313/144; 123/169 EL

(58) Field of Classification Search
USPC ..... 313/118–145; 123/169 R, 169 EL, 32, 123/41, 310
See application file for complete search history.

(56) References Cited

U.S. PATENT DOCUMENTS 5,456,624 A * 10/1995 Moore et al. ..... 445/7
6,470,845 B2 10/2002 Kanao
2002/0130603 A1* 9/2002 Teramura et al. ..... 313/141
2003/0038577 A1* 2/2003 Hori et al. ..... 313/141
2004/0140745 A1 7/2004 Hrastnik
2005/0057133 A1 3/2005 Hori
2007/0290591 A1* 12/2007 Lykowski et al. ..... 313/141

FOREIGN PATENT DOCUMENTS

JP 58-198886 A 11/1983
JP 5-159855 A 6/1993
JP 5135846 A 6/1993
JP 2001-257053 A 9/2001
JP 2001-345162 A 12/2001
JP 2004-165165 A 6/2004
JP 2005-093221 A 4/2005
JP 2006-185853 A 7/2006
JP 2007-172866 A 7/2007

* cited by examiner

*Primary Examiner* — Nimeshkumar Patel
*Assistant Examiner* — Jacob R Stern
(74) *Attorney, Agent, or Firm* — Sughrue Mion, PLLC

(57) ABSTRACT

A ground electrode (27) and a noble-metal chip (32) are joined via a weld portion (42) formed by fusing and mixing an Ni alloy and a Pt alloy. A plurality of acicular or rhizoid microcracks (51) are formed in the weld portion (42). As viewed on a section of the weld portion (42), the average length of the microcracks is 50 μm to 500 μm, and the average aspect ratio (shorter dimension/longer dimension) of the microcracks is 0.05 or less. At least one of the Ni alloy used to form the ground electrode (27) and the Pt alloy used to form the noble-metal chip (32) contains as an additive at least one of elements belonging to Groups 3A and 4A of the Periodic Table and oxides of these elements.

7 Claims, 5 Drawing Sheets

SPARK PLUG FOR INTERNAL COMBUSTION ENGINE

BACKGROUND OF THE INVENTION

1. Field of the Invention

The present invention relates to a spark plug for use in an internal combustion engine.

2. Description of the Related Art

Conventional spark plugs for internal combustion engines such as automobile engines include those in which a chip formed from a noble metal alloy is welded to a distal end portion of a ground electrode. An exemplary material used to form the noble-metal chip is a noble-metal alloy which contains platinum (Pt) as a main component. Also, for example, addition of rhodium (Rh), whose melting point is higher than that of Pt, to a Pt alloy has been proposed as a measure for enhancing resistance to spark consumption (refer to, for example, Patent Document 1).

Furthermore, projecting a noble-metal chip from an electrode and using a noble-metal chip having a reduced diameter have also been proposed as measures for enhancing ignition and spark propagation (refer to, for example, Patent Document 2).

As mentioned above, various measures have been adopted in order to obtain spark plugs having excellent resistance to spark consumption, excellent ignition performance, etc. However, these measures are premised on having a reliable joint between a noble-metal chip and an electrode. In order to meet this need, a technique has been proposed for reliably joining the noble-metal chip and the electrode by laser welding such that the noble-metal chip and the electrode are fused together to form a weld portion (refer to, for example, Patent Document 3).

[Patent Document 1] Japanese Patent Application Laid-Open (kokai) No. 58-198886

[Patent Document 2] Japanese Patent Application Laid-Open (kokai) No. 2001-345162

[Patent Document 3] Japanese Patent Application Laid-Open (kokai) No. 2005-93221

3. Problems to be Solved by the Invention

Meanwhile, in a spark plug having the above-mentioned weld portion, the presence of a relatively large hole called a void in the weld portion deteriorates the mechanical strength of the weld portion. Therefore, generally, the absence of a void or the like in the weld portion as shown in FIG. 6 is desirable.

However, when subjected to severe operating conditions of present day internal combustion engines, even in a spark plug whose weld portion is completely free of a void or the like, the chip may suffer some separation or become disjoined from the electrode. Particularly, in recent years, in order to enhance heat resistance and corrosion resistance, a nickel (Ni) alloy has been employed to form a ground electrode. In such a case, the stress induced by expansion and contraction in a radial direction of the chip differs among the ground electrode and the noble-metal chip. Strain caused by the difference in induced stress is apt to arise in a boundary region between the ground electrode and the noble-metal chip. Also, in association with the recent tendency toward increased projection length and reduced diameter of the noble-metal chip for enhancing ignition performance and flame propagation performance, the strain caused by the thermally induced stress difference is becoming more marked. Accordingly, for example, as shown in FIG. 7, separation may arise at the interface between the noble-metal chip and the weld portion, and, consequently, the chip may become disjoined.

SUMMARY OF THE INVENTION

The present invention has been made in view of the above circumstances, and an object thereof is to provide a spark plug for an internal combustion engine in which a noble-metal chip formed from a platinum alloy is joined to an end portion of an electrode formed from a nickel alloy, and having a structure which restrains separation of the noble-metal chip from the electrode, to thereby enhance durability.

Various configurations suitable for solving the above problems and achieving the above objects of the invention are described as follows. As needed, the function and effects specific to individual configurations will also be described.

Configuration 1: A spark plug for an internal combustion engine comprising an insulator having an axial hole; a center electrode fixedly inserted into the axial hole so as to project from a front end of the insulator; a metallic shell externally holding the insulator; and a ground electrode joined to the metallic shell and having a distal end portion which faces a front end portion of the center electrode so as to define a spark discharge gap between a front end portion of the center electrode and the distal end portion of the ground electrode.

In the spark plug, a noble-metal chip formed from a platinum alloy which contains platinum as a main component is joined to at least one of the center electrode and the ground electrode, and the electrode to which the noble-metal chip is joined is formed from a nickel alloy which contains nickel as a main component.

The noble-metal chip is joined via a weld portion formed by fusing and mixing the nickel alloy of the electrode and the platinum alloy of the noble-metal chip; and the weld portion has a plurality of acicular or rhizoid microcracks formed therein.

Herein, the term "main component" refers to a component whose mass ratio is the highest in the material concerned. The term "acicular or rhizoid microcrack" refers to a slender crack, which differs from a spherical or generally spherical void. Accordingly, cracks having such large sizes as to considerably impair mechanical strength are excluded. Also, a crack is not limited to a single acicular crack, but may be a rhizoid crack which branches into two, three, or more branches. An example of the rhizoid crack is shown in FIG. 4, and is specifically described in the embodiment section below.

According to configuration 1, the noble-metal chip formed from a Pt alloy which contains Pt as a main component is joined to at least one of the center electrode and the ground electrode. This can enhance resistance to spark consumption under high-temperature conditions (the term "electrode" refers to one or both of the center and ground electrodes). As a result, erosion of the noble-metal chip is restrained, whereby durability can be enhanced. Also, since the electrode is formed from an Ni alloy which contains Ni as a main component, heat resistance and corrosion resistance are excellent. Furthermore, the electrode and the noble-metal chip are joined together via the weld portion formed by fusing and mixing an Ni alloy and a Pt alloy. Therefore, basically, the weld portion mitigates stress which is imposed on the electrode and the noble-metal chip as a result of being subjected to repeated cooling and heating, thereby stabilizing a joined condition.

Meanwhile, the difference in material between the electrode and the noble-metal chip may cause a difference in stress. This difference is induced by expansion and contraction in a radial direction of the chip as a result of repeated cooling and heating in association with the combustion cycles of an engine. In this connection, according to configuration 1, a plurality of acicular or rhizoid microcracks are formed in the weld portion. Therefore, the microcracks absorb the stress. Accordingly, strain-induced stress is effectively reduced at the interface between the noble-metal chip and the weld portion or at the interface between the weld portion and the electrode. As a result, even when cooling and heating are repeated, interfacial separation becomes unlikely to occur. This prevents the noble-metal chip from becoming disjoined over a long period of time.

No particular limitation is imposed on the joining method for the noble-metal chip, so long as the weld portion is properly formed. For example, laser welding or electron beam welding may be used. However, resistance welding is not necessarily preferred, since forming a weld portion having microcracks is difficult. Desirably, the weld portion having microcracks is formed such that the microcracks are widely distributed mainly on a side toward the electrode. This is because when the weld portion is divided into a region in which microcracks are formed and a region in which microcracks are not formed. By virtue of the region in which microcracks are formed extending widely on a side toward the electrode, a tendency toward deterioration in mechanical joining strength of the noble-metal chip is avoided. Such structure is desirable for the following reason. When an externally threaded portion of the metallic shell has a small diameter of, for example, M12 or less, the heat transfer capability of a front end portion of the center electrode and a distal end portion of the ground electrode is deteriorated, with a resultant increase in thermal stress generated therein. The greater the thermal stress, the more apparent are the effects of the present invention. Thus, the present invention can be said to be even more effective in application to joining the noble-metal chip to the ground electrode. Accordingly, the following configuration 2 represents a preferred embodiment of the invention.

Configuration 2: In the spark plug for an internal combustion engine according to configuration 1, the noble-metal chip is joined to the ground electrode.

As described above, the formation of microcracks can effectively prevent the noble-metal chip from becoming disjoined. However, this does not necessarily mean that just any cracks will suffice. For example, excessively large cracks can deteriorate the mechanical strength of the weld portion itself. In view of the above, the microcracks desirably meet the conditions specified in the following configurations 3 and 4.

Configuration 3: In the spark plug for an internal combustion engine according to configuration 1, as viewed on a section of the weld portion, the microcracks have an average length within a range of 50 μm to 500 μm inclusive.

Configuration 4: In the spark plug for an internal combustion engine according to any one of configurations 1 to 3, as viewed on a section of the weld portion, the microcracks have an average aspect ratio (shorter dimension/longer dimension) of 0.05 or less.

In configuration 3, the term "length" refers to the distance from an end of a microcrack to another end of the microcrack that is most distant therefrom. The term "average length" refers to the average length of a predetermined number (e.g., 20) of the microcracks.

When the average length of the microcracks is less than 50 μm, the above-mentioned stress-absorbing effect may be insufficient. When the average length of the microcracks exceeds 500 μm, the mechanical strength of the weld portion itself may deteriorate.

In configuration 4, the term "aspect ratio" refers to the ratio of a shorter dimension of a microcrack to a longer dimension of the microcrack. The term "average aspect ratio" refers to the average aspect ratio of a predetermined number (e.g., 20) of the microcracks.

In configuration 4, when the average aspect ratio (shorter dimension/longer dimension) is in excess of 0.05, the mechanical strength of the weld portion itself may deteriorate.

The following conditions are desirably met in order to achieve the above-mentioned configurations in which a plurality of acicular or rhizoid microcracks are formed in the weld portion.

Configuration 5: In the spark plug for an internal combustion engine according to configuration 1, at least one of the Ni alloy forming the electrode to which the noble-metal chip is joined and the Pt alloy forming the noble-metal chip contains as an additive at least one of elements belonging to Groups 3A and 4A of the Periodic Table and oxides of these elements.

When, as in configuration 5, at least one of the Ni alloy forming the electrode and the Pt alloy forming the noble-metal chip contains as an additive at least one of elements belonging to Groups 3A and 4A of the Periodic Table and oxides of these elements, at the time that the Ni and Pt alloys are fused, the additive is dispersed in a region which is to become the weld portion. Conceivably, when the region solidifies to become the weld portion, microcracks are likely formed starting from locations where the additive is present. That is, by employing a configuration in which the Ni alloy and/or the Pt alloy contains the above-mentioned additive, the microcracks can be formed more reliably.

Particularly, the following configurations 6 and 7 are more desirable.

Configuration 6: In the spark plug for an internal combustion engine according to configuration 5, the additive comprises at least one selected from the group consisting of Zr, Y, Nd, $Y_2O_3$, and $ZrO_2$.

Configuration 7: In the spark plug for an internal combustion engine according to configurations 5 or 6, the total content of the additive in the nickel alloy forming the electrode to which the noble-metal chip is joined and in the platinum alloy forming the noble-metal chip is within a range of 0.005% by mass to 0.3% by mass inclusive.

Configurations 6 and 7 more reliably yield the function and effects of configuration 5.

Particularly, when the total content of the additive is less than 0.005% by mass, microcracks are unlikely to be formed. By contrast, when the total content of the additive exceeds 0.3% by mass, workability may be impaired. As mentioned above, a lower limit of the total content of the additive is determined in the light of formation of the microcracks. Thus, at least either the electrode to which the noble-metal chip is joined or the noble-metal chip may contain a total content of the additive that exceeds the lower limit. It is not imperative that both contain a total additive content that exceeds the lower limit. However, it is preferable that both contain a total additive content that exceeds the lower limit. On the other hand, since an upper limit of the total content of the additive affects the workability of the electrode to which the noble-metal chip is joined and that of the noble-metal chip, the electrode to which the noble-metal chip is joined and the noble-metal chip preferably contain the additive in a total content that is less than the upper limit.

As mentioned above, a certain additive content of the weld portion is a requisite for forming microcracks. Therefore, the following configuration 8 is desirable.

Configuration 8: In the spark plug for an internal combustion engine according to configuration 5, a total content of the additive in the weld portion is 0.0025% by mass or more.

Conventionally, in some cases, before the noble metal chip becomes disjoined from the electrode, the electrode itself or the noble-metal chip itself has reached the end of its useful service life. In contrast, by employing any one of configurations 1 to 8, the noble-metal chip is less likely to become disjoined as compared with conventional counterparts. Thus, in order to extend the service life of the spark plug for an internal combustion engine, further enhancement of durability of the electrode itself and the noble-metal chip itself is desirable. Therefore, the following configurations 9 and 10 represent preferred embodiments of the invention.

Configuration 9: In the spark plug for an internal combustion engine according to configuration 1, the Pt alloy forming the noble-metal chip contains Rh in an amount of 3% by mass to 30% by mass inclusive.

Configuration 10: In the spark plug for an internal combustion engine according to any one of configurations 1 to 9, the Ni alloy forming the electrode contains Cr in an amount of 10% by mass to 30% by mass inclusive and Al in an amount of 0.5% by mass to 3.0% by mass inclusive. When, as in configuration 9, the Pt alloy forming the noble-metal chip contains Rh in an amount of 3% by mass to 30% by mass inclusive, durability under high-temperature conditions increases, whereby resistance to spark consumption can be remarkably enhanced.

When, as in configuration 10, the Ni alloy forming the electrode to which the noble-metal chip is joined contains Cr in an amount of 10% by mass to 30% by mass inclusive and Al in an amount of 0.5% by mass to 3.0% by mass inclusive, heat resistance and corrosion resistance can be remarkably enhanced.

DESCRIPTION OF REFERENCE NUMERALS

Figure 1:
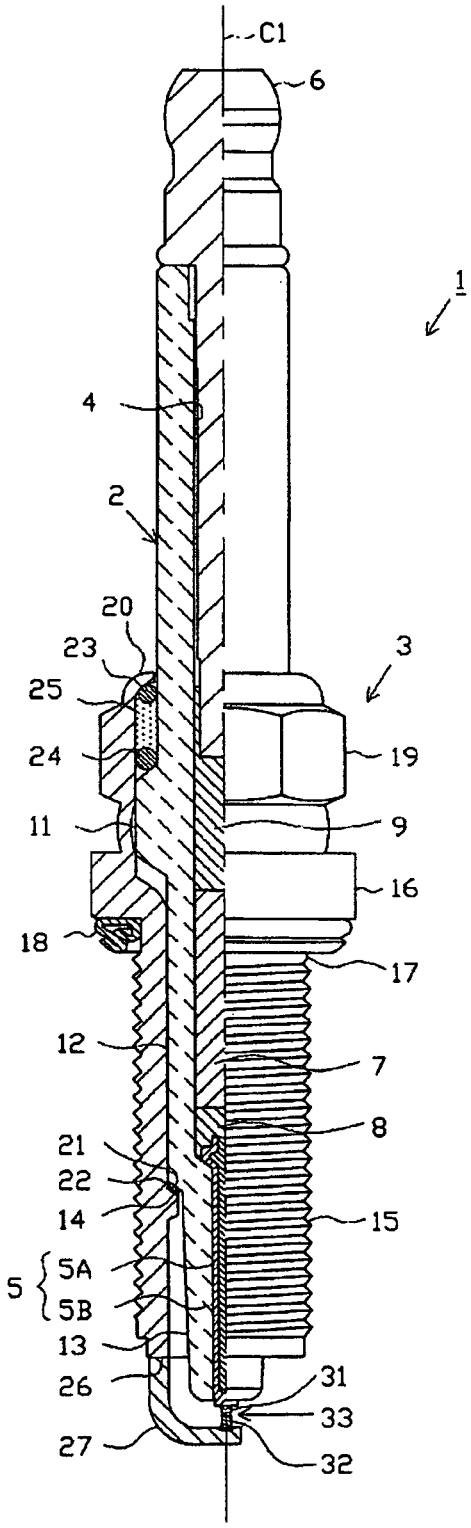
FIG. 1 is a partial sectional front view showing the configuration of a spark plug of the present embodiment.

Reference numerals used to identify various structural features in the drawings include the following.

1: spark plug
2: insulator
3: metallic shell
5: center electrode
27: ground electrode
32: noble-metal chip
33: spark discharge gap
42: weld portion
51: microcrack

Detailed Description of The Preferred Embodiments

An embodiment of the present invention will next be described with reference to the drawings. However, the present invention should not be construed as being limited thereto.

FIG. 1 is a partial sectional front view showing a spark plug 1. In the following description, the direction of an axis C1 of the spark plug 1 in FIG. 1 is referred to as the vertical direction, the lower side of the spark plug 1 in FIG. 1 is referred to as the front side of the spark plug 1, and the upper side as the rear side of the spark plug 1.

The spark plug 1 includes an elongated insulator 2 and a tubular metallic shell 3, which holds the insulator 2.

An axial hole 4 extends through the insulator 2 along the axis C1. A center electrode 5 is fixedly inserted into the front side of the axial hole 4, and a terminal electrode 6 is fixedly inserted into the rear side of the axial hole 4. A resistor 7 is disposed within the axial hole 4 between the center electrode 5 and the terminal electrode 6. Opposite end portions of the resistor 7 are electrically connected to the center electrode 5 and the terminal electrode 6 via electrically conductive glass seal layers 8 and 9, respectively.

The center electrode 5 is fixed so as to project from the front end of the insulator 2, and the terminal electrode 6 is fixed so as to project from the rear end of the insulator 2. A noble-metal chip 31 is welded to the front end of the center electrode 5 (described below).

Meanwhile, the insulator 2 is formed from alumina or the like by firing, as is well known in this field of art. The insulator 2 includes a flange-like large-diameter portion 11, which projects radially outward at a substantially central portion, with respect to the direction of the axis C1, of the insulator 2; an intermediate trunk portion 12, which is located frontward of the large-diameter portion 11 and is smaller in diameter than the large-diameter portion 11; and a leg portion 13, which is located frontward of the intermediate trunk portion 12, is smaller in diameter than the intermediate trunk portion 12, and is exposed to a combustion chamber of an internal combustion engine. The front side of the insulator 2 including the large-diameter portion 11, the intermediate trunk portion 12, and the leg portion 13 are accommodated in the tubular metallic shell 3. A stepped portion 14 is formed at a connection portion between the leg portion 13 and the intermediate trunk portion 12. The insulator 2 is fitted to the metallic shell 3 via the stepped portion 14.

The metallic shell 3 is formed from low-carbon steel or the like into a tubular shape. The metallic shell 3 has a threaded portion (externally threaded portion) 15 on its outer circumferential surface, and the threaded portion 15 is used to attach the spark plug 1 to an engine head. The metallic shell 3 has a seat portion 16 formed on its outer circumferential surface and located rearward of the threaded portion 15. A ring-like gasket 18 is fitted to a screw neck 17 located at the rear end of the threaded portion 15. The metallic shell 3 also has a tool engagement portion 19 provided near its rear end. The tool engagement portion 19 has a hexagonal cross section and allows a tool such as a wrench to be engaged therewith when the metallic shell 3 is to be attached to the engine head. Furthermore, the metallic shell 3 has a crimp portion 20 provided at its rear end portion and adapted to hold the insulator 2.

The metallic shell 3 has a stepped portion 21 provided on its inner circumferential surface and adapted to allow the insulator 2 to be seated thereon. The insulator 2 is inserted frontward into the metallic shell 3 from the rear end of the metallic shell 3. In a state in which the stepped portion 14 of the insulator 2 abuts the stepped portion 21 of the metallic shell 3, a rear-end opening portion of the metallic shell 3 is crimped radially inward; i.e., the crimp portion 20 is formed, whereby the insulator 2 is fixed in place. An annular sheet packing 22 intervenes between the stepped portions 14 and 21 of the insulator 2 and the metallic shell 3, respectively. This retains airtightness of the combustion chamber and prevents leakage of an air-fuel mixture to the exterior of the spark plug 1 through a clearance between the inner circumferential surface of the metallic shell 3 and the leg portion 13 of the insulator 2, which leg portion 13 is exposed to the combustion chamber.

In order to ensure airtightness which is established by crimping, annular ring members 23 and 24 intervene between the metallic shell 3 and the insulator 2 in a region near the rear end of the metallic shell 3, and a space between the ring members 23 and 24 is filled with talc powder 25. That is, the metallic shell 3 holds the insulator 2 via the sheet packing 22, the ring members 23 and 24, and the talc powder 25.

A generally L-shaped ground electrode 27 is joined to a front end face 26 of the metallic shell 3. Specifically, a proximal end portion of the ground electrode 27 is welded to the front end face 26 of the metallic shell 3, and a portion of the ground electrode 27 located on a side toward the distal end of the ground electrode 27 is bent such that a side face of the portion faces a front end portion (noble-metal chip 31) of the center electrode 5. A noble-metal chip 32 is provided on the ground electrode 27 so as to face the noble-metal chip 31. A gap between the noble-metal chips 31 and 32 serves as a spark discharge gap 33.

Figure 2:
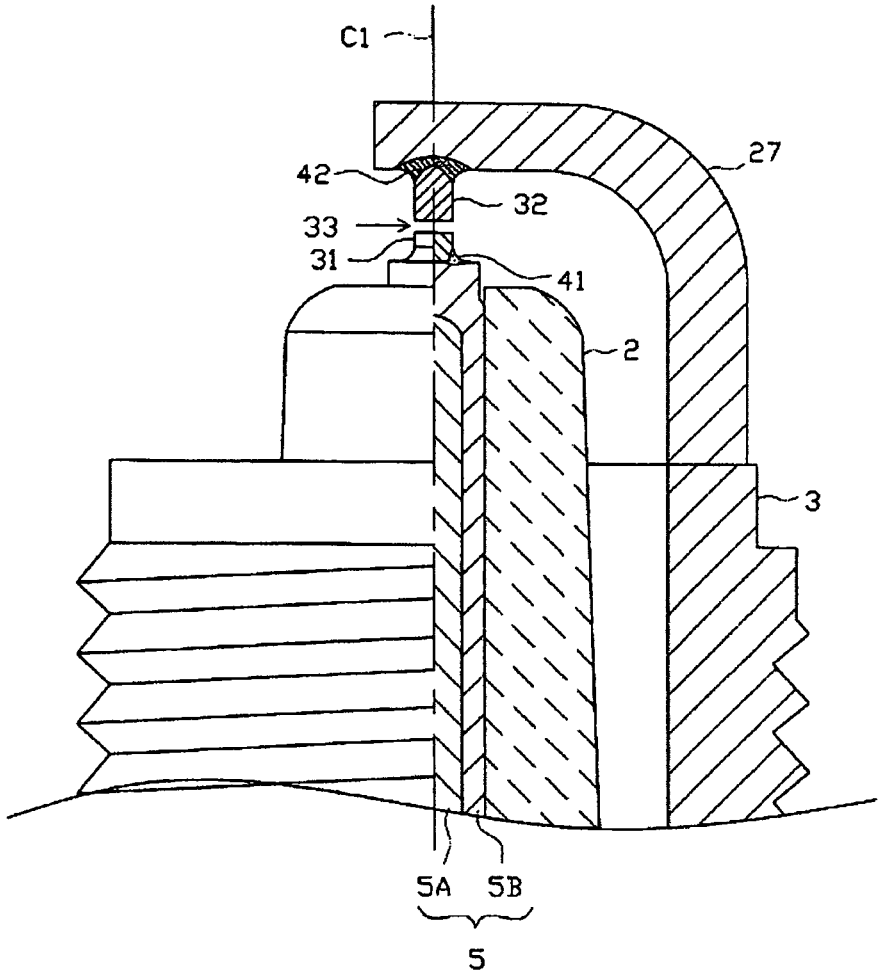
FIG. 2 is an enlarged partial view, partially in section, of the spark plug of FIG. 1.

As shown in FIG. 2, the center electrode 5 includes an inner layer 5A of copper or a copper alloy, and an outer layer 5B of a nickel (Ni) alloy. The ground electrode 27 is formed from an Ni alloy.

The center electrode 5 has a diameter-reduced portion located on a side toward its front end; assumes a rodlike (columnar) shape as a whole; and has a flat front end face. The columnar noble-metal chip 31 is placed in contact with the end face of the center electrode 5. Laser welding, electron beam welding, or the like is performed along the circumference of a joint interface between the noble-metal chip 31 and the center electrode 5. As a result, the noble-metal chip 31 and the center electrode 5 fuse to thereby form a weld portion 41. That is, the noble-metal chip 31 is fused to the front end of the center electrode 5 via the weld portion 41, whereby the noble-metal chip 31 is joined to the center electrode 5.

Meanwhile, the noble-metal chip 32, which faces the noble metal chip 31, is joined to a distal end portion of the ground electrode 27. Specifically, the noble-metal chip 32 is positioned at a predetermined position on the ground electrode 27. Laser welding, electron beam welding, or the like is performed along the circumference of a joint interface between the noble-metal chip 32 and the ground electrode 27. As a result, the noble-metal chip 32 and the ground electrode 27 fuse to thereby form a weld portion 42. That is, the noble-metal chip 32 is fused to the distal end portion of the ground electrode 27 via the weld portion 42, whereby the noble-metal chip 32 is joined to the ground electrode 27 (described below).

The noble-metal chip 31 of the center electrode 5 may be omitted. In this case, the spark discharge gap 33 is formed between the noble-metal chip 32 and a body portion of the center electrode 5.

In the present embodiment, the noble-metal chips 31 and 32 (particularly, the noble-metal chip 32 of the ground electrode 27) contain platinum (Pt) as a main component and rhodium (Rh). Rh may be omitted. However, in view of enhancing durability of the noble-metal chip 32 itself, Rh is desirably contained in an amount of 3% by mass to 30% by mass inclusive. Also, in the present embodiment, the noble-metal chip 32 contains as an additive at least one of elements belonging to Groups 3A and 4A of the Periodic Table and oxides of those elements. Specifically, desirably, the noble-metal chip 32 contains as an additive at least one of zirconium (Zr), yttrium (Y), neodymium (Nd), yttrium oxide ($Y_2O_3$) and zirconium oxide ($ZrO_2$). In the present embodiment, the total content of the additive is in a range of 0.005% by mass to 0.3% by mass inclusive.

Meanwhile, the Ni alloy used to form the ground electrode 27 contains chromium (Cr) in an amount of 10% by mass to 30% by mass inclusive and aluminum (Al) in an amount of 0.5% by mass to 3.0% by mass inclusive. This enhances durability of the ground electrode 27 itself Also, the above-mentioned additive may be contained in the ground electrode 27. That is, the additive may be contained in either the above-mentioned Pt alloy or the Ni alloy, or in both of the Pt alloy and the Ni alloy. In either case, the total content of the additive in both of the alloys is desirably in a range of 0.005% by mass to 0.3% by mass inclusive.

The noble-metal chips 31 and 32 are formed, for example, in the following manner. First, an ingot which contains Pt as a main component is prepared. Also, alloy components (in the present embodiment, Rh, etc.) are prepared so as to make, together with the ingot, the above-mentioned predetermined composition. The ingot and the alloy components are fused. A new ingot is formed from the fused alloy. Subsequently, the new ingot is subjected to hot forging and hot rolling (grooved rolling), followed by wire drawing so as to yield a wire material. The thus-obtained wire material is cut into pieces each having a predetermined length, thereby yielding columnar noble-metal chips 31 and 32.

Figure 3:
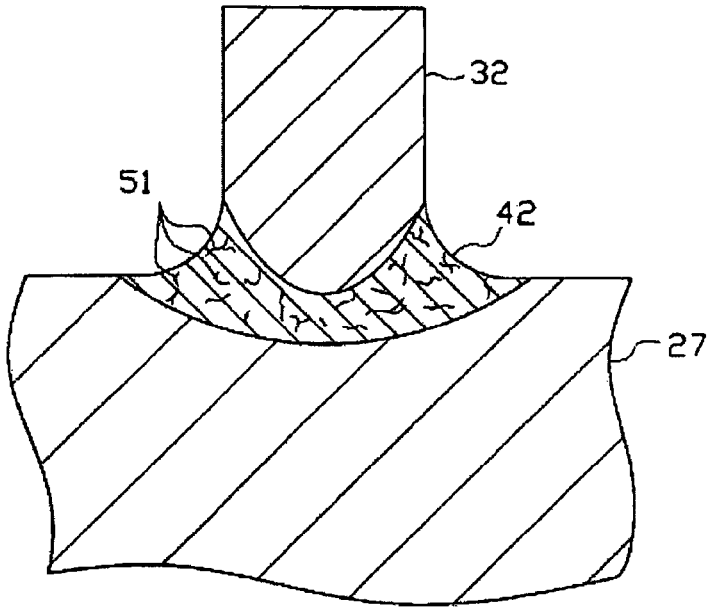
FIG. 3 is an enlarged partial sectional view schematically showing a weld portion.

As mentioned above, in the present embodiment, the noble-metal chip 32 and the ground electrode 27 are subjected to laser welding, electron beam welding, or the like and thus fused, to thereby form the weld portion 42. That is, the noble-metal chip 32 is fused to the ground electrode 27 via the weld portion 42, whereby the noble-metal chip 32 is joined to the ground electrode 27. Furthermore, in the present embodiment, as shown in FIG. 3, a plurality of acicular or rhizoid microcracks 51 are formed in the weld portion 42. The "acicular or rhizoid microcracks 51" differ from spherical or generally spherical voids, but rather refer to slender cracks. Accordingly, cracks having such large sizes so as to considerably impair material strength are excluded. Also, the microcrack 51 is not limited to a single acicular microcrack, but may be a rhizoid microcrack having branches. In the present embodiment, as viewed on a section of the weld portion 42, the average length of the microcracks 51 is 50 μm to 500 μm, and the average aspect ratio (shorter dimension/longer dimension) of the microcracks 51 is 0.05 or less. It is considered that the microcracks 51 are induced mainly by the presence of the above-mentioned additive. Specifically, when at least one of the Ni alloy used to form the ground electrode 27 and the Pt alloy used to form the noble-metal chip 32 contains the above-mentioned additive, at the time of fusing the Ni alloy and the Pt alloy, the additive is dispersed in a region which is to become the weld portion 42. It is considered that when the region solidifies to become the weld portion 42, the microcracks 51 are formed starting from locations where the additive is present.

The weld portion 42 contains the above-mentioned additive in an amount of 0.0025% by mass or more.

Next, a method of manufacturing the thus-configured spark plug 1 will be described. First, the metallic shell 3 is prepared. Specifically, a columnar metal material (e.g., an iron material, such as S17C or S25C, or a stainless steel material) is subjected to cold forging so as to form a through-hole therein and to impart a rough shape thereto. Subsequently, the workpiece is subjected to machining for external shaping, thereby yielding a metallic-shell intermediate.

Then, the ground electrode 27 formed from an Ni alloy (e.g., an INCONEL alloy) is resistance-welded to the front end face of the metallic-shell intermediate. Resistance welding is accompanied by formation of so-called "sags." Thus, the sags are removed. Subsequently, the threaded portion 14 is formed by rolling at a predetermined portion of the metallic-shell intermediate, thereby yielding the metallic shell 3 to which the ground electrode 27 is welded. The metallic shell 3 to which the ground electrode 27 is welded is subjected to galvanization or nickel plating. In order to enhance corrosion resistance, the plated surface may further undergo a chromate process.

Furthermore, the above-mentioned noble-metal chip 32 is joined to a distal end portion of the ground electrode 27 by laser welding, electron beam welding, or the like. In order to ensure welding, before the welding process is performed, plating is removed from a welding region, or masking is applied, before the plating process, to a region which will become the welding region. Also, the noble-metal chip 32 may be welded after an assembling process described below.

Meanwhile, separately from preparation of the metallic shell 3, the insulator 2 is formed. Specifically, a forming material granular-substance is prepared by use of, for example, a material powder which contains alumina in a predominant amount, a binder, etc. By use of the prepared granular substance, a tubular green compact is formed by rubber press forming. The thus-formed green compact is ground for shaping. The shaped green compact is placed in a kiln, followed by firing. The fired compact is subjected to various polishing processes, thereby yielding the insulator 2.

Also, separately from preparation of the metallic shell 3 and the insulator 2, the center electrode 5 is formed. Specifically, an Ni alloy is subjected to forging, and the inner layer 5A made of a copper alloy is disposed in a central portion of the forged Ni alloy so as to enhance heat radiation. The above-mentioned noble-metal chip 31 is joined to a front end portion of the center electrode 5 by resistance welding, laser welding, or the like.

The insulator 2 and the center electrode 5, which are formed as mentioned above, the resistor 7, and the terminal electrode 6 are fixed in a sealed condition by means of the glass seal layers 8 and 9. The glass seal layers 8 and 9 are prepared generally by mixing borosilicate glass and a metal powder. The thus-prepared mixture is injected into the axial hole 4 of the insulator 2 so as to sandwich the resistor 7. Subsequently, in a state in which the terminal electrode 6 is pressed from the rear, the resultant assembly is fired in a kiln. At this time, a glazed trunk portion of the insulator 2 located on a side toward the rear end of the insulator 2 may be simultaneously fired so as to form a glaze layer; alternatively, the glaze layer may be formed beforehand.

Subsequently, the thus-formed insulator 2 having the center electrode 5 and the terminal electrode 6, and the metallic shell 3 having the ground electrode 27 are assembled. More specifically, a relatively thin-walled rear-end opening portion of the metallic shell 3 is crimped radially inward; i.e., the above-mentioned crimp portion 20 is formed, thereby fixing the insulator 2 and the metallic shell 3.

Finally, the ground electrode 27 is bent so as to form the spark discharge gap 33 between the noble-metal chip 31 provided on the front end of the center electrode 5 and the noble-metal chip 32 provided on the ground electrode 27.

Through a series of steps mentioned above, the spark plug 1 having the above-mentioned configuration is manufactured.

Figure 4:
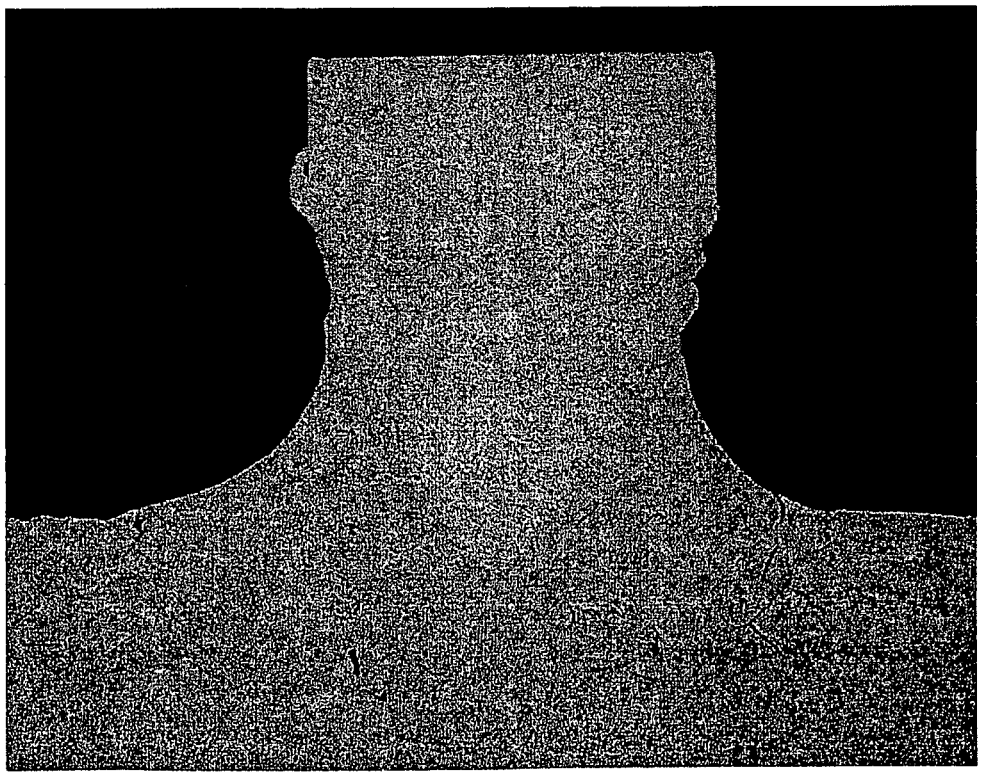
FIG. 4 is a sectional photograph showing a state in which microcracks are formed in the weld portion.
Figure 5:
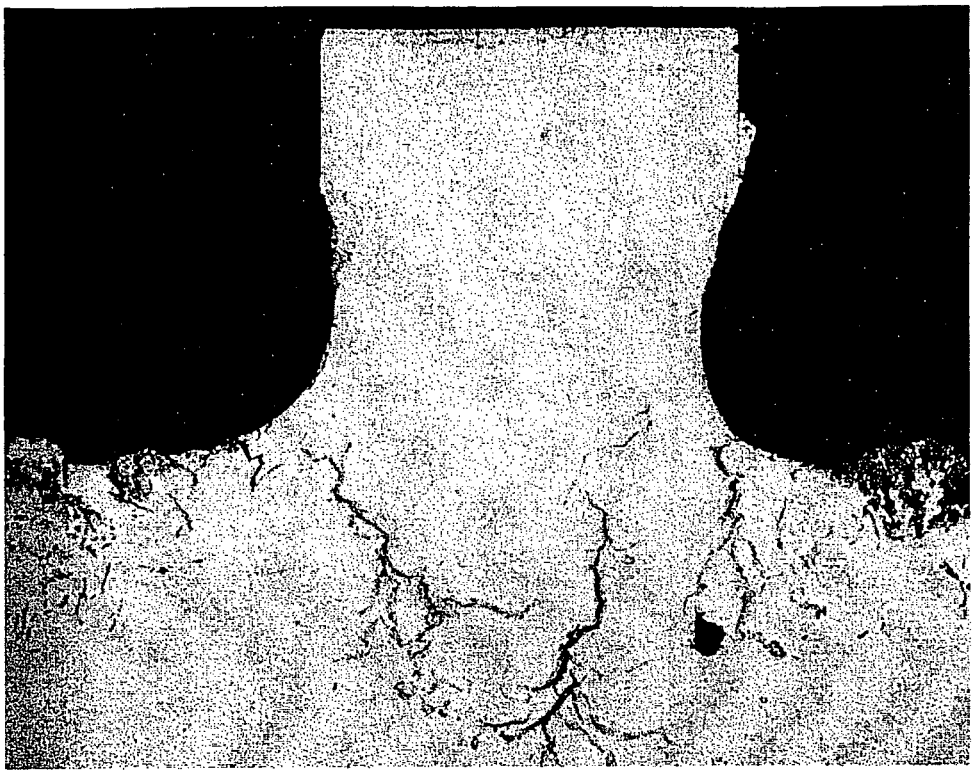
FIG. 5 is a sectional photograph showing the state of a sample after a temperature cycle test in which microcracks are formed in the weld portion.
Figure 6:
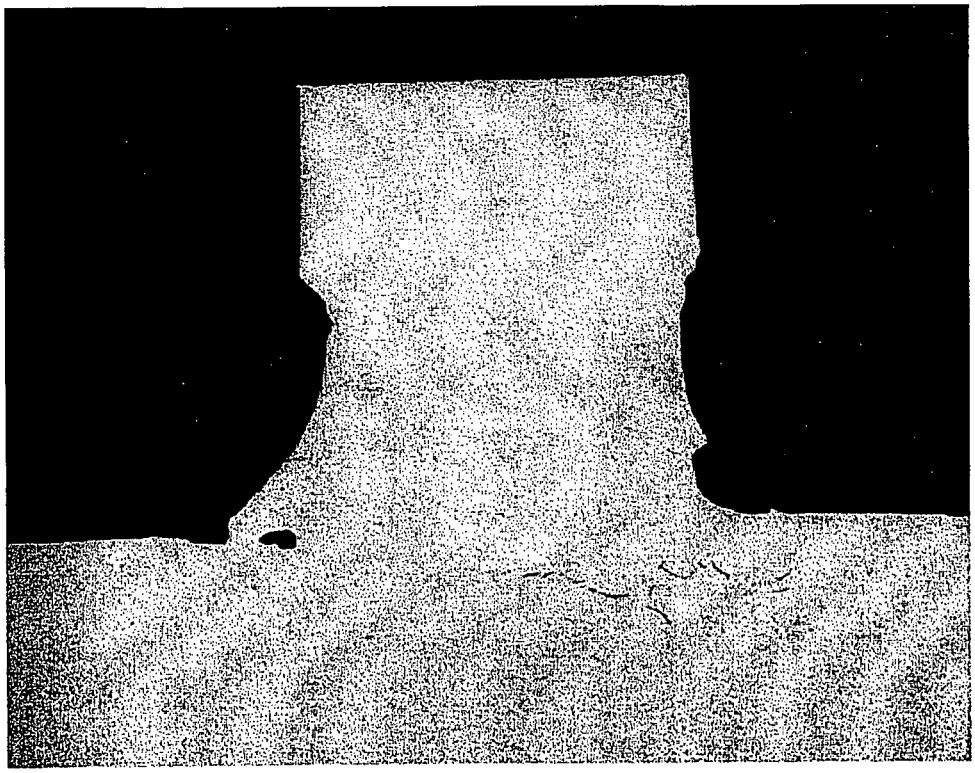
FIG. 6 is a sectional photograph showing a state in which cracks and the like are not formed in the weld portion.
Figure 7:
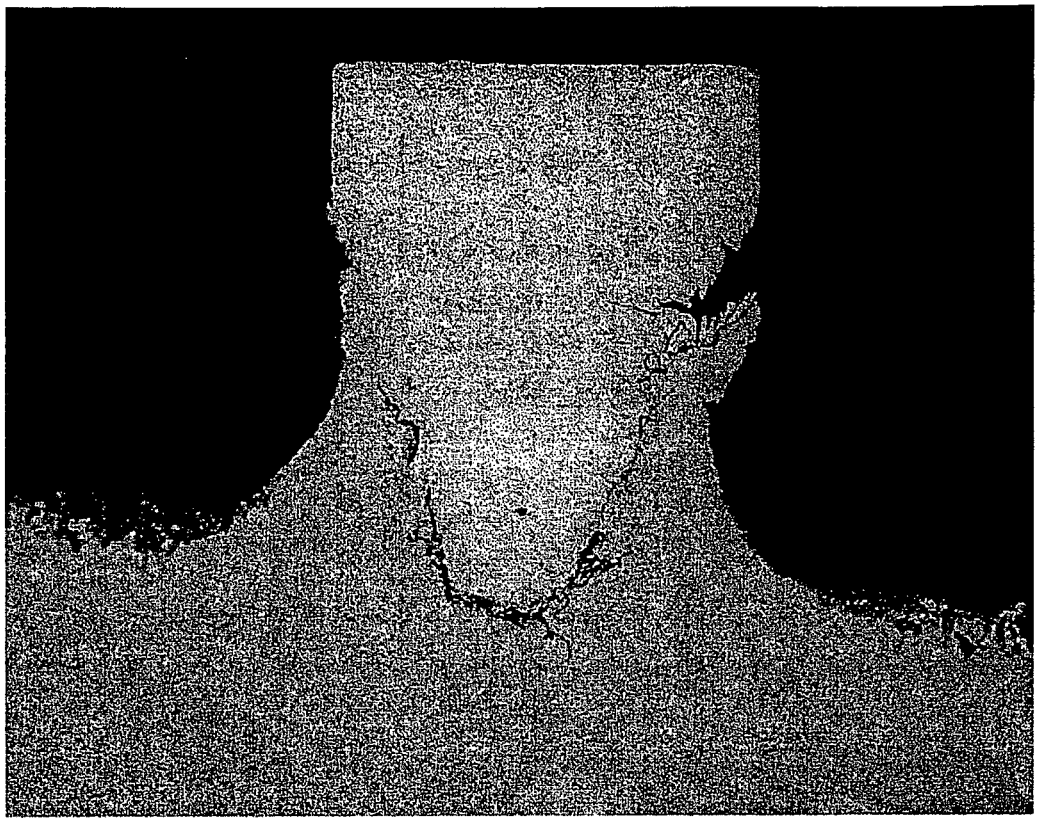
FIG. 7 is a sectional photograph showing a state of a sample after the temperature cycle test in which cracks and the like are not formed in the weld portion.

According to the thus-configured spark plug 1 of the present embodiment, the ground electrode 27 and the noble-metal chip 32 are joined via the weld portion 42 which is formed by fusing and mixing the Ni alloy and the Pt alloy. Therefore, basically, the weld portion 42 mitigates stress which is imposed on the ground electrode 27 and the noble-metal chip 32 as a result of being subjected to repeated cooling and heating, thereby stabilizing a joined condition. Meanwhile, the difference in material between the ground electrode 27 and the noble-metal chip 32 may cause a difference in stress which is induced by expansion and contraction in a radial direction of the noble-metal chip 32 as a result of repeated cooling and heating. In this connection, according to the present embodiment, a plurality of acicular or rhizoid microcracks 51 are formed in the weld portion 42 (see the sectional photograph of FIG. 4). Therefore, the microcracks 51 absorb the stress. Accordingly, strain-induced stress imposed at the interface between the noble-metal chip 32 and the weld portion 42 or at the interface between the weld portion 42 and the ground electrode 27 is effectively reduced. As a result, even when cooling and heating are repeated, interfacial separation is unlikely to occur so that the noble-metal chip 32 remains attached to the electrode over a long period of time. FIG. 5 is a sectional photograph of Sample 14, described below, taken after a high-frequency temperature-cycle test. As is apparent from FIG. 5, even after the temperature cycle test, interfacial separation is not observed.

In order to verify the function and effects of the present embodiment, various samples of differing configuration were prepared and evaluated. The evaluation and test results are described below.

As indicated in Table 1, various ground electrode samples were prepared which contained Ni as a main component and differed in the content of other components, and various noble-metal chip samples were prepared which contained Pt as a main component and differed in the content of other components. The noble-metal chip samples were joined to the corresponding ground electrode samples by laser welding, thereby preparing samples (Samples 1 to 22). Weld portion sections of the samples were observed through an electron microscope, and the average lengths of the respective microcracks were measured. Also, the samples were subjected to a durability evaluation test. The evaluation results are shown in Table 1.

Durability was evaluated by a temperature cycle test using a burner (durability evaluation test). More specifically, one cycle of the test operation consisted of heating the electrode assembly for two minutes at 1,000° C. and allowing it to stand intact (cooling) for one minute. The test operation was repeated for 10,000 cycles. When the length of interfacial separation (following the durability test) between the noble chip and the weld portion is found to be less than 10% of the overall length at the interface as measured on a half section, which is vertically terminated at the axis of the chip, durability is evaluated as sufficient and is expressed by "AA"; when the length is found to be 10% or more but less than 25% of the overall length, durability is evaluated as fair and is expressed by "BB"; when the length is found to be 25% or more but less than 50% of the overall length, durability is evaluated as acceptable and is expressed by "CC"; and when the length is found to be 50% or more of the overall length, durability is evaluated as poor and is expressed by "DD." In Table 1, figures appearing in the component columns are given in units of % by mass.

TABLE 1

| Sample | Ground Electrode | | | | | | Noble-metal Chip | | | | | | | | Average length of microcracks | Durability |
|---|---|---|---|---|---|---|---|---|---|---|---|---|---|---|---|---|
| No. | Ni | Cr | Fe | Al | Y | Zr | Pt | Ir | Rh | Ni | Zr | Y | Nd | Others | (μm) | Evaluation |
| 1 | 63 | 25 | 10 | 2 | — | — | 80 | — | 20 | — | — | — | — | — | less than 30 | DD |
| 2 | 62.8 | 25 | 10 | 2 | 0.1 | 0.1 | 80 | 20 | — | — | — | — | — | — | 50-400 | BB |
| 3 | 63 | 25 | 10 | 2 | — | — | 79.9 | — | 20 | — | — | — | — | Hf 0.1 | 30-50 | CC |
| 4 | 63 | 25 | 10 | 2 | — | — | 79.9 | — | 20 | — | — | — | — | Sm 0.1 | 30-50 | CC |
| 5 | 63 | 25 | 10 | 2 | — | — | 79.9 | — | 20 | — | — | — | — | $ThO_2$0.1 | 30-50 | CC |
| 6 | 63 | 25 | 10 | 2 | — | — | 79.9 | — | 20 | — | 0.1 | — | — | — | 50-400 | AA |
| 7 | 63 | 25 | 10 | 2 | — | — | 79.9 | — | 20 | — | — | 0.1 | — | — | 50-400 | AA |
| 8 | 63 | 25 | 10 | 2 | — | — | 74.995 | 20 | 5 | — | — | — | 0.005 | — | 50-400 | AA |
| 9 | 63 | 25 | 10 | 2 | — | — | 79.9 | — | 20 | — | — | — | 0.1 | — | 50-400 | AA |
| 10 | 63 | 25 | 10 | 2 | — | — | 79.9 | — | 20 | — | 0.05 | 0.05 | — | — | 50-400 | AA |
| 11 | 62.8 | 25 | 10 | 2 | 0.1 | 0.1 | 80 | — | — | 20 | — | — | — | — | 50-400 | BB |
| 12 | 62.8 | 25 | 10 | 2 | 0.1 | 0.1 | 97 | — | 3 | — | — | — | — | — | 50-400 | AA |
| 13 | 62.8 | 25 | 10 | 2 | 0.1 | 0.1 | 80 | — | 20 | — | — | — | — | — | 50-400 | AA |
| 14 | 63.5 | 25 | 10 | 1.5 | — | — | 79.9 | — | 20 | — | $ZrO_2$0.1 | — | — | — | 50-400 | AA |
| 15 | 63.5 | 25 | 10 | 1.5 | — | — | 79.9 | — | 20 | — | — | $Y_2O_3$0.1 | — | — | 50-400 | AA |
| 16 | 72.5 | 15 | 10 | 2.5 | — | — | 79.9 | — | 20 | — | $ZrO_2$0.1 | — | — | — | 50-400 | AA |
| 17 | 63.497 | 25 | 10 | 1.5 | 0.003 | — | 80 | 20 | — | — | — | — | — | — | 30-50 | CC |
| 18 | 63.495 | 25 | 10 | 1.5 | 0.005 | — | 80 | 20 | — | — | — | — | — | — | 50-400 | BB |
| 19 | 77.4 | 10 | 10 | 2.5 | 0.1 | — | 79.9 | — | 20 | — | — | $Y_2O_3$0.1 | — | — | 50-400 | AA |
| 20 | 80.4 | 7 | 10 | 2.5 | 0.1 | — | 79.9 | — | 20 | — | — | $Y_2O_3$0.1 | — | — | 50-400 | BB |
| 21 | 64.4 | 25 | 10 | 0.5 | 0.1 | — | 79.9 | — | 20 | — | — | $Y_2O_3$0.1 | — | — | 50-400 | AA |
| 22 | 64.9 | 25 | 10 | 0 | 0.1 | — | 79.9 | — | 20 | — | — | $Y_2O_3$0.1 | — | — | 50-400 | BB |

As shown in Table 1, in Sample 1, in which none of elements belonging to Groups 3A and 4A of the Periodic Table and oxides of these elements is contained as additive, microcracks are hardly formed in the weld portion, and the average length of microcracks is less than 30 μm. In this case, durability was found to be poor.

Meanwhile, in Samples 2 to 22, in which the ground electrode or the noble-metal chip contained as an additive at least one of elements belonging to Groups 3A and 4A of the Periodic Table and oxides of these elements, microcracks whose average length is 30 μm or more were formed in the respective weld portions. In this case, it was found that the required minimum durability can be secured. Particularly, when the ground electrode and/or the noble-metal chip contains as an additive at least one of Zr, Y, Nd, $Y_2O_3$ and $ZrO_2$ in a total amount of 0.005% by mass to 0.3% by mass, the microcracks have assumed an average length of 50 μm to 400 μm, and durability ranging from fair durability to sufficient durability has been secured.

Also, it has been revealed that, even in the case of ground electrodes having the same composition, when the noble-metal chip contains Rh in an amount of 3% by mass or more, durability can be enhanced more reliably. Furthermore, it has been revealed that, even in the case of noble-metal chips having the same composition, when the ground electrode contains Cr in an amount of 10% by mass and Al in an amount of 0.5% by mass or more, durability can be enhanced more reliably.

The present invention is not limited to the above-described embodiment, but may be embodied, for example, as follows.

(a) Table 1, which shows the evaluation results for verifying the function and effects of the present embodiment, does not cover those cases in which the average length of microcracks exceeds 400 μm. An average length of microcracks in excess of 400 μm is acceptable. However, in view of ensuring a predetermined strength, the average length of the microcracks is desirably 500 μm or less.

(b) In the above-described embodiment, the section of the weld portion 42 extends from one lateral end to the opposite lateral end. However, the weld portion 42 may be interrupted without extending between the lateral ends.

(c) In the above-described embodiment, an ingot which contains Pt as a main component is prepared; alloy components are prepared so as to make, together with the ingot, a predetermined composition; the ingot and the alloy components are fused; and the resultant fused alloy is used to form the noble-metal chips 31 and 32. However, the noble-metal chips 31 and 32 may be formed by mixing alloy component powders (granules) so as to make a predetermined composition; compacting the resultant mixture; sintering the resultant compact so as to yield a sintered alloy; and forming the noble-metal chips 31 and 32 from the sintered alloy.

(d) The type of spark plug is not limited to that of the above-described embodiment. Therefore, a spark plug having a plurality of ground electrodes may be embodied. For example, a spark plug may be embodied which has two ground electrodes (of course, three or more ground electrodes may be provided) and in which a noble-metal chip is joined to each of the ground electrodes via a weld portion formed at a distal end face of the ground electrode.

(e) According to the above-described embodiment, the ground electrode 27 is joined to the front end of the metallic shell 3. However, the present invention is applicable to the case where a portion of a metallic shell (or, a portion of an end metal piece welded beforehand to the metallic shell) is formed into a ground electrode by machining (refer to, for example, Japanese Patent Application Laid-Open (kokai) No. 2006-236906).

(f) According to the above-described embodiment, a plurality of acicular or rhizoid microcracks 51 are formed in the weld portion 42, which weld portion serves as a joint portion between the ground electrode 27 and the noble-metal chip 32. However, the technical concept of the present invention may be applied to the case where a plurality of microcracks are formed in the weld portion 41 which serves as a joint portion between the center electrode 5 and the noble-metal chip 31.

It should further be apparent to those skilled in the art that various changes in form and detail of the invention as shown and described above may be made. It is intended that such changes be included within the spirit and scope of the claims appended hereto.

This application is based on Japanese Patent Application No. 2007-217472 filed Aug. 23, 2007, incorporated herein by reference in its entirety.

What is claimed is:

1. A spark plug for an internal combustion engine, comprising:

an insulator having an axial hole;

a center electrode fixedly inserted into the axial hole so as to project from a front end of the insulator;

a metallic shell externally holding the insulator; and a ground electrode joined to the metallic shell and having a distal end portion which faces a front end portion of the center electrode so as to define a spark discharge gap between a front end portion of the center electrode and the distal end portion of the ground electrode, wherein:

a noble-metal chip formed from a platinum (Pt) alloy which contains platinum as a main component is joined to at least one of the front end portion of the center electrode and the distal end portion of the ground electrode, and the electrode to which the noble-metal chip is joined is formed from a nickel (Ni) alloy which contains nickel as a main component;

the noble-metal chip is joined via a weld portion formed by fusing and mixing the nickel alloy of the electrode and the platinum alloy of the noble metal chip by laser welding; and the weld portion has a plurality of acicular or rhizoid microcracks, wherein, as viewed on a section of the weld portion, the microcracks have an average length within a range of 50 μm to 500 μm inclusive, wherein at least one of the nickel alloy forming the electrode to which the noble-metal chip is joined and the platinum alloy forming the noble-metal chip contains one or more additives selected from the group consisting of at least one of elements belonging to Groups 3A and 4A of the Periodic Table and oxides of these elements, wherein the weld portion has a fusion zone along the circumference of a joint interface between the noble-metal chip and the at least one electrode, wherein the total content of the one or more additives in the nickel alloy forming the electrode to which the noble-metal chip is joined and in the platinum alloy forming the noble-metal chip is within a range of 0.005% by mass to 0.3% by mass inclusive, and wherein the nickel alloy forming the electrode to which the noble-metal chip is joined contains chromium (Cr) in an amount of 10% by mass to 30% by mass inclusive and aluminum (Al) in an amount of 0.5% by mass to 3.0% by mass inclusive.

2. The spark plug for an internal combustion engine according to claim 1, wherein the noble-metal chip is joined to the ground electrode.

3. The spark plug for an internal combustion engine according to claim 1, wherein, as viewed on a section of the weld portion, an average aspect ratio (shorter dimension/longer dimension) of the microcracks is 0.05 or less.

4. The spark plug for an internal combustion engine according to claim 1, wherein a total content of the one or more additives in the weld portion is 0.0025% by mass or more.

5. The spark plug for an internal combustion engine according to claim 1, wherein the platinum alloy forming the noble-metal chip contains rhodium (Rh) in an amount of 3% by mass to 30% by mass inclusive.

6. The spark plug for an internal combustion engine according to claim 1, wherein the additive is selected from the group consisting of at least one of zirconium (Zr), yttrium (Y), neodymium (Nd), yttrium oxide ($Y_2O_3$) and zirconium oxide ($ZrO_2$).

7. The spark plug for an internal combustion engine according to claim 6, wherein the total content of the one or more additives in the nickel alloy forming the electrode to which the noble-metal chip is joined and in the platinum alloy forming the noble-metal chip is within a range of 0.005% by mass to 0.3% by mass inclusive.

* * * * *